United States Patent [19]

Simon

[11] Patent Number: 4,727,998

[45] Date of Patent: Mar. 1, 1988

[54] TAMPER EVIDENT CLOSURE

[76] Inventor: B. Kenneth Simon, 40 Woodhaven Dr., Pittsburgh, Pa. 15228

[21] Appl. No.: 18,285

[22] Filed: Feb. 24, 1987

Related U.S. Application Data

[63] Continuation-in-part of Ser. No. 879,478, Jun. 27, 1986, abandoned.

[51] Int. Cl.[4] ..... B65D 41/34

[52] U.S. Cl. ..... 215/230; 215/254

[58] Field of Search ..... 215/253, 254, 252, 230

[56] References Cited

U.S. PATENT DOCUMENTS

| | | | |
|---|---|---|---|
| 2,169,686 | 8/1939 | Fabrice | 215/254 |
| 4,209,101 | 6/1980 | Brown | 215/253 |
| 4,261,478 | 4/1981 | Summers | 215/256 X |
| 4,452,363 | 6/1984 | Davis | 215/258 X |
| 4,456,136 | 6/1984 | Palsson | 215/254 X |
| 4,471,878 | 9/1984 | Davis et al. | 215/258 X |
| 4,548,329 | 10/1985 | Curry | 215/252 X |
| 4,567,991 | 2/1986 | Anderson | 215/256 X |

*Primary Examiner*—Donald F. Norton

*Attorney, Agent, or Firm*—Buell, Ziesenheim, Beck & Alstadt

[57] ABSTRACT

A tamper evident mechanism for a bottle and closure assembly. The bottle and closure each have engaging means adapted for engagement with each other upon clockwise rotation of the closure means and for becoming interlocked against counterclockwise rotation to prevent removal of the closure. A tear tab and associated frangible strips are provided on the skirt of the closure. The tear tab is disposed within an indentation on the outer surface of the closure. Pulling off the tear tab along the frangible strips accomplishes removal of the interlocked engaging means, freeing the closure for counterclockwise rotation and removal. At the same time a gaping hole is imparted to the skirt of the cap providing visual evidence of tampering.

40 Claims, 11 Drawing Figures

TAMPER EVIDENT CLOSURE

This application is a continuation-in-part of Ser. No. 879,478, filed June 27, 1986, now abandoned.

This invention relates to a tamper evident closure cap and to its combination with a bottle or other container, especially bottles for containing any product that will be affected by additions, substitutions or extractions from or to it.

The closure cap and the container are generally constructed of plastic but the container can be constructed of glass or metal. The closure cap has a circular top from which a cylindrical skirt depends, which is the only skirt that is required. The cylindrical skirt has an outer skirt surface and an inner skirt surface. The inner skirt surface is provided with internal threads. The bottle has a cylindrical neck having external threads for mating engagement with said internal threads. In one embodiment, a series of external teeth project directly from the exterior cylindrical surface of the neck of the bottle at a level on the neck below the threads. A complementary series of internal teeth are provided in the closure inner skirt surface at a level below said internal threads. The internal teeth and the external teeth are both cammed to enable the teeth to readily engage each other upon clockwise rotation of the cap on the neck of the bottle when the cap is screwed tightly onto the bottle. However, following the cam the internal and external teeth are each provided with a precipitous edge to provide a ratchet and pawl design whereby the two series of teeth easily engage each other upon closing but any attempt to remove the cap from the bottle by counterclockwise rotation finds the teeth irrevocably interlocked to prevent counterclockwise rotation. Furthermore, it is preferred that the cap is not a highly resilient material and that the cap is too rigid for squeezing to release the interlocked teeth.

In accordance with this invention, the only way a user can release the interlocked teeth is by tearing off that portion of the skirt of the closure cap containing the internal teeth. For this purpose, an indentation is provided on the outer skirt surface of the cap for accommodating a tear tab which extends upwardly from a pair of vertical thin rupturable strips at the base of the skirt. The pair of rupturable strips includes one strip on each side of the series of internal teeth on the skirt. The user can insert a finger or narrow utensil into a space provided between the indentation and the tear tab and then grasp the tear tab and pull it downwardly to rupture the frangible strips and to tear away from the cap the segment of the skirt that contains the internal teeth, leaving a conspicuous gap on the circumference of the base of the skirt. After the portion of the skirt containing the internal teeth is torn away, the cap is free for counterclockwise rotation for opening, and for subsequent closing without further interlocking. Most importantly, the gap on the side of the cap makes it visually and notoriously evident that the cap has been tampered with.

Other embodiments of ratchet and pawl-type interlocking mechanisms can be employed. In each, one engaging means of the ratchet and pawl mechanism is on the cap and the other and complementary engaging means is on the bottle. In one example, one engaging means of the mechanism comprises a circumferential bead on the neck of the bottle below the exterior threads. The upper surface of the bead is curved and the lower surface is flat and inclined downwardly in a direction away from the neck of the bottle. The other and complementary engaging means of the mechanism comprises a shoulder projecting inwardly and upwardly from the lower region of the inner skirt surface, below the interior threads. When the cap is screwed onto the bottle, the shoulder rides over the curved surface of the bead and flexes upwardly until it passes the bead and then snaps downwardly and becomes locked in place along the flat lower surface of the bead.

It is an important feature of this invention that an indentation is provided on the outer skirt surface to receive the tear tab. The indentation may be in a non-embossed skirt thick enough to accommodate it, but preferably is accommodated in an embossed outer skirt surface or on a skirt surface having protecting vertical ridges only on each side of the tear tab to protect the tear tab from entanglement with an external object in an assembly line. As recited herein, an indentation in a non-embossed skirt surface can be a depression in the surface and an indentation in an embossed skirt surface can be an interruption or omission of embossments to receive the tear tab, with or without a further depression in the skirt surface. The indentation is associated with and located above rupturable means to facilitate removal of the tear tab. A second indentation can be provided above the first to facilitate grasping the top of the tab. The second indentation can comprise a bevel at the intersection of the skirt and the top of the cap. Thereby, the tear tab does not protrude radially beyond the widest outside circumference of the remainder of the skirt and generally conforms with the widest outside circumference of the remainder of the skirt. If desired, the entire outside circumference of the skirt of the cap can be provided with a series of embossments of similar surface elevation as the tear tab, with the indentation for the tear tab being an interruption of the embossments. As stated, the indentation can comprise entirely the interruption of the embossments or it can comprise an interruption of the embossments plus a further depression in the outer skirt surface. One advantage of avoiding protrusion of the tear tab beyond the outside circumference of the remainder of the skirt is that during assembly line handling, the loosenable tear tab will be protected from being caught and pulled by an external object, such as an adjacent cap.

The internal teeth, shoulder, or other engaging means on the base of the inner skirt surface in the segment of the skirt defined by the frangible strips and beneath the tear tab will easily enter into engagement with the exterior teeth, bead, or other engaging means on the neck of the bottle upon clockwise rotation of the closure cap. However, both series of teeth or the bead are partially cam shaped with the cam leading to a precipitous edge so that the engagement results in a ratchet engagement that blocks counterclockwise rotation for removing the closure. If such counterclockwise rotation is forced, it will induce tearing of the skirt at the frangible joints, indicating that the container has been tampered with.

The embossments on the exterior of the skirt can have a radial elevation equal to the radial elevation at the exterior surface of the tear tab. A small clearance space is provided beneath the tear tab to permit the user to insert a fingernail or a flat utensil to force the tear tab away from the skirt so that the tab can be grasped and torn off from the skirt along the frangible indentations on either side of the tab. If desired, any suitable instructional indicia can be embossed on the closure top such as: "To open, grasp tear tab on side of closure and tear out tamper evident section."

Tamper evident closures presently in use employ a lock band disposed entirely below the skirt of a closure and extending around the entire circumference of the neck of a bottle with the lock band attached to the skirt by means of frangible webs. Rotation of the cap fractures the webs and allows the closure to rotate free of the lock band. However, this arrangement has the disadvantage that tampering can be easily disguised by removing the detached lock band and by neatly trimming vestiges of the webs from the base of the skirt. A casual observer would not be able to detect that there had been a lock band which had been removed or that there had been connecting webs that were broken. By way of contrast, in accordance with this invention, the tearing away of an integral portion of a single closure skirt to interrupt the circumferential continuity of the skirt proper provides glaring visual evidence of tampering. The absence of the tear tab exposes the indentation on the skirt as further visual evidence of disfigurement of the closure. This evidence can be enhanced by an arrow embossed on the top together with any suitable embossed instruction indicia on the top calling attention to a tamper evident section.

The tear tab does not project radially outwardly beyond the circumference of the skirt or beyond the outer circumference of any surface embossments on the skirt. The tear tab has a radius of curvature which is equal to the radius of curvature of the cap and therefore the tear tab lies on the outer circumference of the cap. Therefore, it is possible to prevent interlocking of tear tabs with each other on a conveyor belt while feeding closures to a capping machine. Such interlocking could cause the tear tabs to rupture and become unusable prior to installation on the bottle. There are still other reasons for the importance of this feature. One method of installing caps on bottles is by the use of two rotating bands or wheels on a horizontal plane that are moved sufficiently close together to grasp the closure and then turn it onto the bottle. If there were a circumferentially projecting tear tab, the rotating bands or wheels would wrench the tab and rupture the tamper evident section rendering the closure unusable. Still another method of applying the closures to bottles involves the use of an inverted hollow cone which descends onto the top perimeter of a closure and by friction turns the closure onto the bottle. Here again, protecting the tear tab by an indentation prevents undue pressure and torque from being applied to the tear tab, which could rupture it.

Many other advantages inure because the tamper evident mechanism of the closure of this invention is incorporated within the confines of the overall geometric dimensions of the cap that would exist in its absence. There is a conservation of material and of cost of production. Because the size of the closure is not increased, it is possible to provide the maximum number of cavities usable for a given size of mold frame. In addition, the design of this invention does not require a change in the dimensions of the neck size of the bottle. Therefore, existing bottle designs can be utilized with only a slight modification to incorporate the exterior tamper evident teeth. This can be accomplished by a change in the neck ring of the bottle, which is modest in cost, as opposed to building new molds. Furthermore, the present design does not increase the height of the neck, whereby existing carton designs can be employed.

These features of the tamper evident design of this invention are contrasted with the tamper evident design disclosed in U.S. Pat. No. 4,548,329 to Curry. That patent provides a tamper evident feature by means of an annular portion projecting radially outwardly from the base of the skirt of a closure cap. The annular portion is provided with a second skirt having internal teeth which interlock with external teeth on a complementary shoulder projecting radially from the neck of a bottle. According to the patented design, the interlocked teeth are disengaged by tearing out a segment of the annular portion with a segment of the second skirt, leaving the first skirt undisturbed. Thereupon, the remainder of the annular portion and the remainder of the second skirt remain as projecting parts as an indication of tampering. In the Curry patent the tamper evident mechanism extends considerably beyond the overall geometric dimensions of both the closure cap and the neck of the bottle that would exist in its absence. This imparts a considerable increase not only in material cost but also in manufacturing cost because of a longer cooling time after molding necessitated by the additional material particularly as it applies to the neck of the bottle. Also, this allows a possibility of disguising tampering by cutting off radially projecting parts after tampering. In sharp contrast to the radially projecting mechanism of the Curry patent, the entire tamper evident mechanism of the present invention is indented into and exists within the overall geometric dimensions of the closure cap aside from the tamper evident mechanism.

This invention will be more clearly understood by reference to the attached drawings in which.

Figure 1:
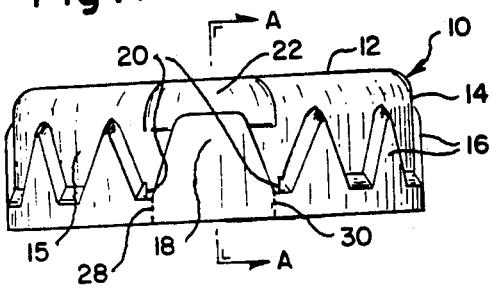
FIG. 1 shows a side view of a closure cap having embossments on the surface of the skirt.
Figure 2:
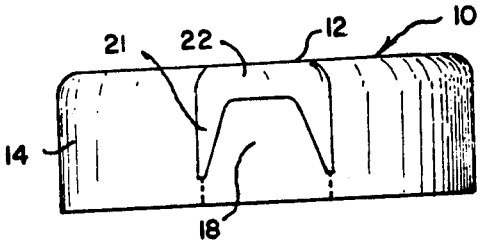
FIG. 2 shows a side view of a closure cap without embossments on the surface of the skirt.
Figure 5:
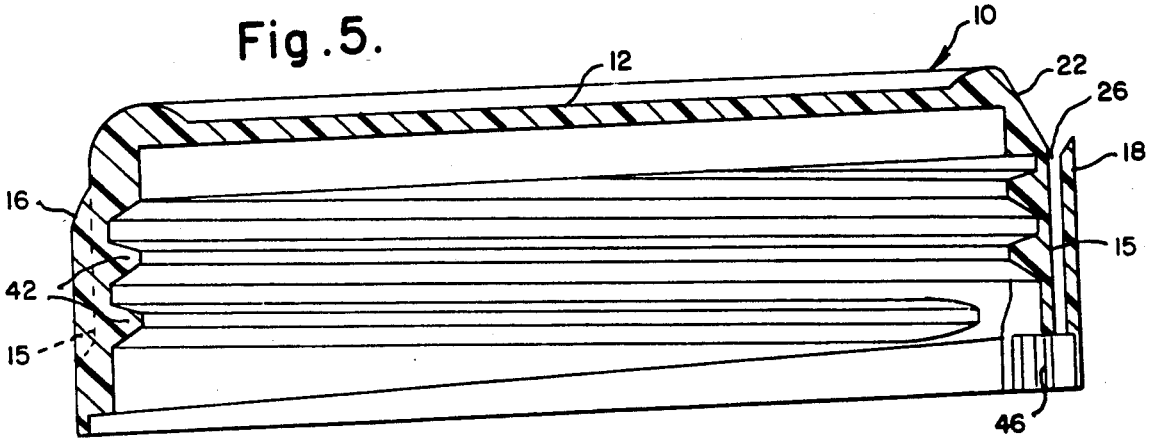
FIG. 5 shows a cross-sectional view of the closure cap through the section A—A of FIG. 1.

FIG. 1 shows closure cap 10 having a circular top 12 and single cylindrical skirt 14. Skirt 14 may be decorated with an embossed design, such as crown-like design 16. Design 16 is interrupted at positions 20 to provide a curved indentation to accommodate tear flap 18. If desired, skirt 14 can be decorated with embossments only on each side of tear flap 18. The interruptions at positions 20 provide a non-embossed region; i.e. a depression relative to adjacent embossments 16. If desired, a depression or excavation can also be provided relative to non-embossed regions 15 of skirt 14. FIG. 2 presents a non-embossed skirt requiring excavation or depression 21 in the surface of the skirt proper. The region 22 extending above depressed region 21 and tear flap 18 is depressed relative to tear flap 18 and is depressed relative to its adjacent surfaces on skirt 14. Region 22 can comprise a bevel at the intersection of skirt 14 and top 12. At the bottom of interruptions 20 and at each side of region 21 is one of a pair of rupturable strips 28 and 30. Tear flap 18 extends upwardly from frangible strips 28 and 30. The indentation provided by embossment interruptions 20 provide a clearance space 26 (FIGS. 3 and 5) between tear flap 18 and non-embossed region 15 of closure cap 10. Thereby, tear flap 18 does not protrude outwardly from the center of cap 10 to a greater radial extent than embossments 16, as is clearly shown in FIG. 3. As recited herein, interruptions 20 in embossments 16 (FIG. 1) and depression 21 on a non-embossed skirt surface (FIG. 2) each denote an indentation for tear flap 18.

Figure 4:
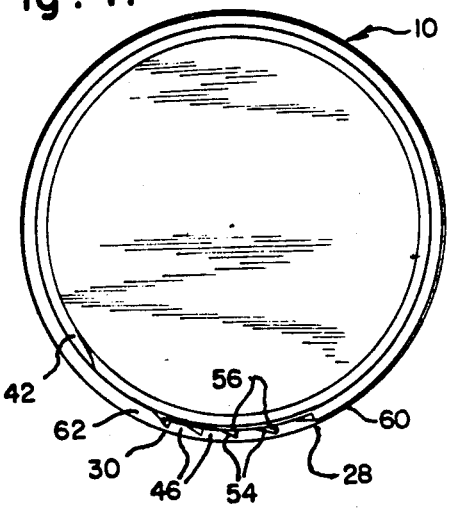
FIG. 4 shows a bottom view of a closure cap.
Figure 6:
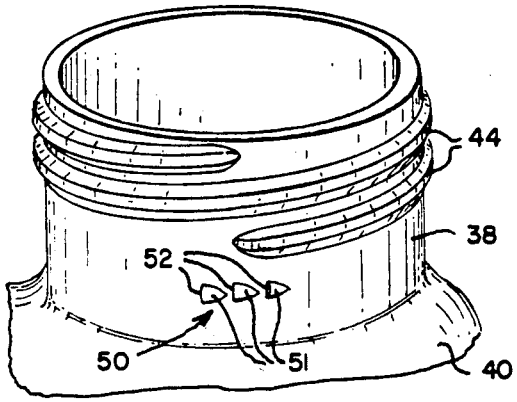
FIG. 6 is an isometric view of a bottle neck having external tamper evident teeth.
Figure 7:
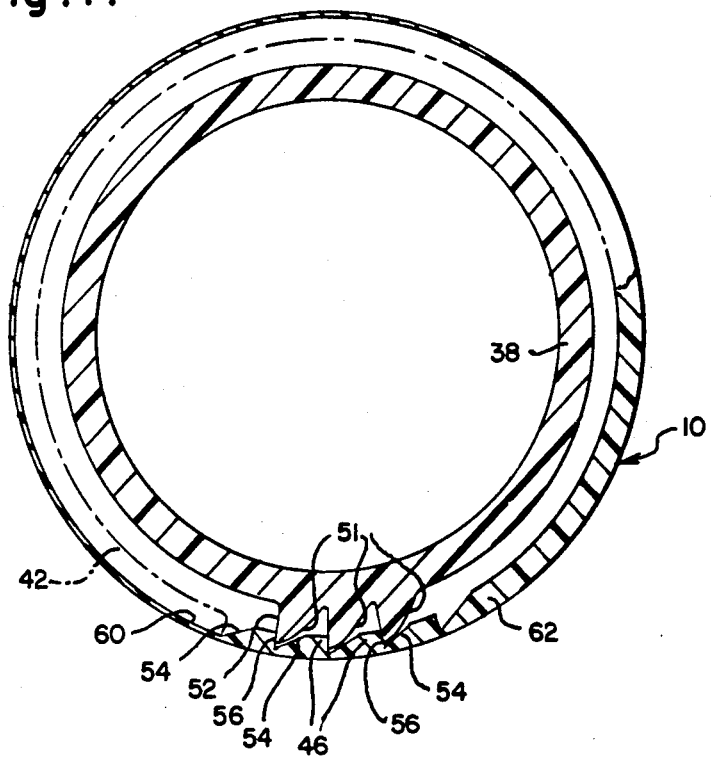
FIG. 7 is a cross-sectional view of a closure cap and bottle neck in screwed engagement with the internal and external teeth interlocked.
Figure 9:
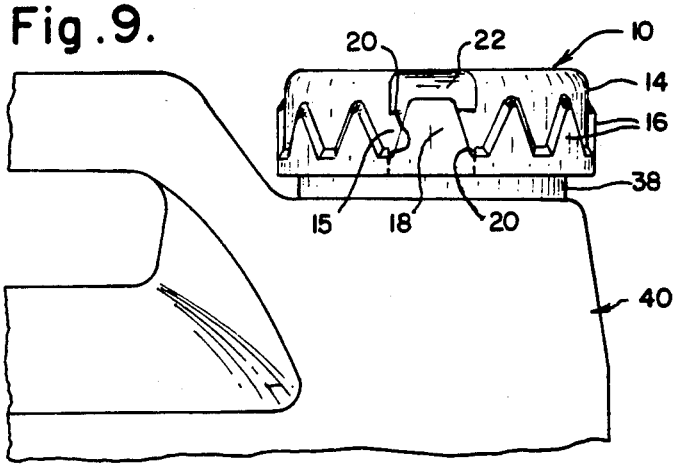
FIG. 9 shows a fragment of a tamper evident bottle with closure cap engaged.
Figure 8:
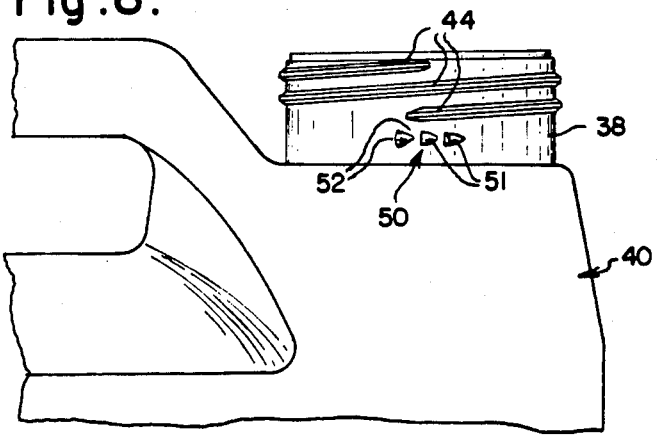
FIG. 8 shows a fragment of a tamper evident bottle.

Container 40 (FIGS. 8, 9 and 10) may be plastic, glass or metal. When closure 10 is tightly screwed onto neck 38 of container 40 by the mating engagement of interior threads 42 in cap 10 (FIG. 5) with exterior threads 44 on neck 38 (FIG. 8), interior teeth 46 at the base of cap 10 (FIG. 4) mesh with exterior teeth 50 on neck 38 of bottle 40 (FIG. 6), which meshing is shown in FIG. 7. Exterior teeth 50 have cammed or curved surfaces 51 and a non-cammed precipitous edge 52, as shown in FIGS. 6 and 7. Precipitous edge 52 can form a right angle with respect to neck 38 or an acute angle with respect to neck 38. Similarly, interior teeth 46 have cammed surfaces 54 and non-cammed precipitous edges 56, as shown in FIGS. 4 and 7. The angle of precipitous edges 56 can be complementary to the angle of precipitous edges 52.

FIG. 7 makes it apparent that when cap 10 is rotated clockwise to threadedly tightly engage cap 10 onto neck 38 of bottle 40, cammed surfaces 54 on the interior teeth in cap 10 ride over cammed surfaces 51 on the exterior surface of neck 38 and the inner and outer series of teeth become interlocked, prohibiting counterclockwise rotation due to abutting edge surfaces 52 and 56. Thereby, the two series of teeth interlock as a pawl and ratchet mechanism, preventing removal of cap 10. Cap 10 cannot be unscrewed from neck 38 unless the series of teeth 46 is torn away from series of teeth 50.

It is noted that interior teeth 46 are embedded within the interior surface of skirt 14, rather than residing on the surface as do threads 42. This is accomplished by providing a thinning clearance at the base of the interior wall of skirt 14 at the level of interior teeth 46, as shown at 60, as compared to a normally thicker wall 62 following interior teeth 46. Thereby, the base of cap 10 will provide clearance for exterior teeth 50 when the base of cap 10 begins to rotate over teeth 50 and cap 10 will not significantly flex or distort teeth 50 until teeth 50 engage interior teeth 46. However, interior teeth 46 can also be on the interior surface of skirt 14 and the recitation that the teeth 46 are in the interior skirt surface means that teeth 46 are either in or on the interior surface of skirt 14.

Figure 10:
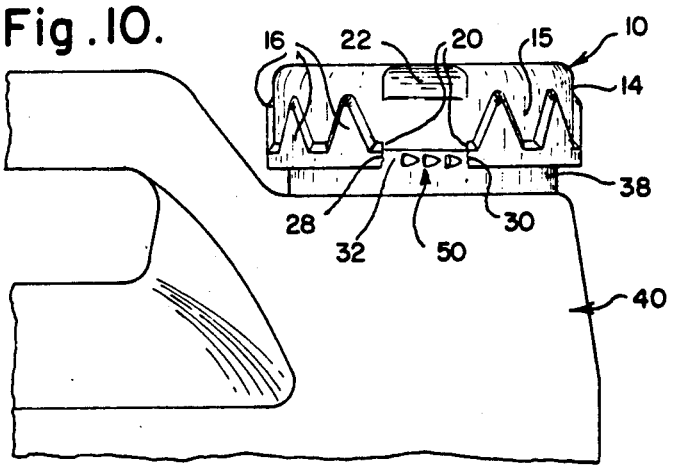
FIG. 10 shows a fragment of a tamper evident bottle with closure cap engaged and tear tab expunged.

FIGS. 1 and 4 show that embossed skirt 14 of closure cap 10 is provided with very thin tear-out strips or perforations 28 and 30 on either side of tear tab 18. Thereby, a user can insert a finger or a thin utensil into space 26 (FIGS. 3 and 5), fold back tear tab 18, grasp tear tab 18 with finger and thumb pull it outwardly and downwardly to tear if off along frangible strips 28 and 30. Removal of tear tab 18 concomitantly removes the series of teeth 46, breaking the interlock. After tab 18 is removed, FIG. 10 shows that tear strips 28 and 30 define a gaping opening 32, indicating circumferential discontinuity along the bottom of cap 10, exposing exterior teeth 50 and providing visual evidence of tampering.

Figure 3:
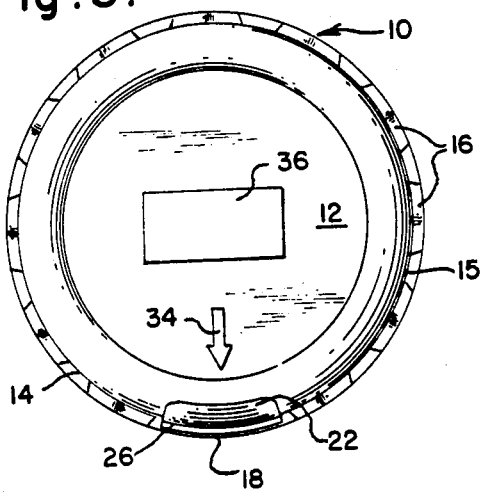
FIG. 3 shows a top view of a closure cap.

FIG. 3 shows that tamper evidence can be made even more prominent by embossing arrow 34 on top 12 pointing in the direction of tear flap 18 coupled with embossed directions in area 36 referring to a tamper evident section.

Cap 10 is preferably sufficiently rigid to prevent squeezing of cap 10 to effect release of interlocked teeth 46 from teeth 50. Thereby, the ratchet and pawl engagement of teeth 46 and teeth 50 guarantees utilization of the tamper evidence feature to effect removal of cap 10.

Figure 11:
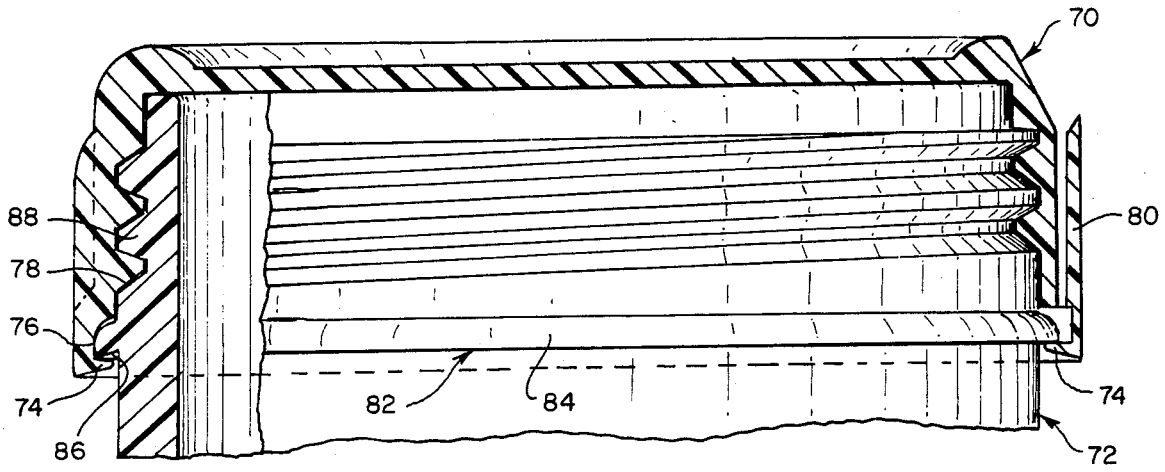
FIG. 11 shows a partially cutaway view of a tamper proof bottle and closure cap combination.

FIG. 11 shows cap 70 and bottle neck 72 in combination. Cap 70 is similar to cap 10 shown in FIG. 5 except that instead of the interlocking teeth of cap 10, cap 70 employs shoulder 74 which extends inwardly and upwardly from the skirt inner surface 76 of cap 70 near the bottom of said inner surface and below interior threads 78. Shoulder 74 can extend around the entire inner circumference of skirt inner surface 76 or along only a portion of said circumference or only along the inner surface of tear tab 80, with the proviso that at least a portion of shoulder 74 is along the inner surface of tear tab 80, whichever arrangement expedites disengagement of cap 70 upon removal of tear tab 80. Upon assembly of cap 70 onto bottle 72 shoulder 74 interlocks with circumferential bead 82 which extends around the entire periphery of the neck of bottle 72 at a position below exterior threads 88.

Circumferential bead 82 is comprised of curved upper surface 84 and flat lower surface 86. Lower surface 86 extends downwardly and outwardly from the neck of bottle 72. When cap 70 is screwed downwardly onto the neck of bottle 72, shoulder 74 flexes upwardly as it passes over curved surface 84 of bead 82. When shoulder 74 reaches a level below bead 84, it unflexes and snaps free of bead 84 and becomes locked below flat surface 86 of bead 84, as shown in FIG. 11. In order for shoulder 74 to pass upwardly across bead 82, tear tab 80 must be removed. If shoulder 74 is confined only to the removed region, then cap 70 is free to rotate off of bottle 72. If shoulder 74 extends beyond the removed region, the normal rigidity possessed by shoulder 74 is relaxed upon removal of tear tab 80, and shoulder 74 is enabled to flex downwardly to permit upwardly passage past bead 82. In either case, removal of tear tab 80 enables removal of cap 70 and the non-removal of tear tab 80 prohibits removal of cap 70 from bottle 72.

I claim:

1. In combination, a container having a neck portion and a closure therefor, said neck portion having an outer cylindrical neck surface, exterior threads on said outer cylindrical neck surface, first engaging means extending from said outer cylindrical neck surface at a level below said exterior threads, said closure having a circular top and a cylindrical skirt depending therefrom, said cylindrical skirt having an outer skirt surface and an inner skirt surface, interior threads on said inner skirt surface for mating engagement with said exterior threads, second engaging means extending from said inner skirt surface at a level below said interior threads, said second engaging means adapted for engagement with said first engaging means upon clockwise rotation of said closure on said neck portion and for becoming interlocked against counterclockwise rotation, rupturable means on said skirt on each side of said second engaging means, an indentation on said outer skirt surface above said rupturable means, tear tab means extending from said rupturable means and along said indentation for tearing away a segment of said skirt containing said second engaging means at said rupturable means, said tearing away freeing counterclockwise rotation of said closure means and leaving a circumferential gap on said skirt, said gap providing visual evidence of tampering.

2. The combination of claim 1 wherein said first engaging means is a circumferential bead.

3. The combination of claim 2 wherein said circumferential bead comprises a curved upper surface and a flat lower surface.

4. The combination of claim 1 wherein said first engaging means is a circumferential bead having a curved upper surface and a flat lower surface, said flat lower surface being inclined downwardly and outwardly from said neck surface.

5. The combination of claim 1 wherein said second engaging means comprises an inwardly extending shoulder on the lower region of said inner skirt surface.

6. The combination of claim 1 wherein said second engaging means comprises an inwardly and upwardly extending shoulder on the lower region of said inner skirt surface.

7. The combination of claim 1 wherein said first engaging means is a series of exterior teeth on said neck surface.

8. The combination of claim 1 wherein said second engaging means is a series of interior teeth in said inner skirt surface.

9. The combination of claim 1 wherein said container and said closure are too rigid for squeezing to disengage said first engaging means and said second engaging means.

10. The combination of claim 1 wherein said first engaging means is cammed on one side and has a precipitous edge on the other side.

11. The combination of claim 1 including embossments on said outer skirt surface, said indentation comprising an omission of said embossments in the region of said rupturable means.

12. The combination of claim 1 wherein said tab means does not protrude radially beyond the circumferential confines of said outer skirt surface.

13. The combination of claim 11 wherein said tab means does not protrude radially beyond the circumferential confines of said embossments.

14. The combination of claim 1 including indicia embossments on said top.

15. A plastic closure cap for providing tamper evidence comprising a circular top and a cylindrical skirt depending therefrom, said cylindrical skirt having an outer skirt surface and an inner skirt surface, interior threads on said inner skirt surface for mating engagement with exterior threads on the neck of a container, first engaging means extending from said inner skirt surface at a level below said interior threads for ratchetly interlocking engagement with complementary engaging means on the neck of said container below said exterior threads, rupturable means on said skirt on each side of said first engaging means, an indentation on said outer skirt surface above said rupturable means, tear tab means extending from said rupturable means and along said indention for tearing away a segment of said skirt containing said first engaging means at said rupturable means, said tearing away leaving a circumferential gap on said skirt, said gap providing visual evidence of tampering.

16. The closure cap of claim 15 wherein said closure cap is too rigid for squeezing to disengage said first engaging means and said complementary engaging means.

17. The closure cap of claim 15 including embossments on said outer skirt surface, said indentation comprising an omission of said embossments in the region of said rupturable means.

18. The closure cap of claim 15 wherein said tab means does not protrude radially beyond the circumferential confines of said outer skirt surface.

19. The closure cap of claim 17 wherein said tab means does not protrude beyond the circumferential confines of said embossments.

20. The closure cap of claim 15 including indicia embossments on said top.

21. The closure cap of claim 15 including a bevel on said skirt surface at the intersection of said skirt and said top to facilitate grasping said tab for tearing.

22. The closure cap of claim 15 wherein said first engaging means comprises an inwardly extending shoulder on the lower region of said inner skirt surface.

23. The closure cap of claim 22 wherein said shoulder extends on said skirt beyond said rupturable means.

24. The closure cap of claim 15 wherein said first engaging means comprises an inwardly and upwardly extending shoulder on the lower region of said inner skirt surface.

25. In combination, a container having a neck portion and a closure therefor, said neck portion having an outer cylindrical neck surface, exterior threads on said outer cylindrical neck surface, a series of exterior teeth on said outer cylindrical neck surface at a level below said exterior threads, said closure having a circular top and a cylindrical skirt depending therefrom, said cylindrical skirt having an outer skirt surface and an inner skirt surface, interior threads on said inner skirt surface for mating engagement with said exterior threads, a series of interior teeth in said inner skirt surface at a level below said interior threads, said series of exterior teeth and said series of interior teeth adapted for engagement with each other upon clockwise rotation of said closure on said neck portion and for becoming ratchetly interlocked against counterclockwise rotation, rupturable means on said skirt on each side of said interior series of teeth, an indentation on said outer skirt surface above said rupturable means, tear tab means extending from said rupturable means and along said indentation for tearing away a segment of said skirt containing said series of interior teeth at said rupturable means, said tearing away freeing counterclockwise rotation of said closure means and leaving a circumferential gap on said skirt, said gap providing visual evidence of tampering.

26. The combination of claim 25 wherein said container and said closure are too rigid for squeezing to disengage said interlocked teeth.

27. The combination of claim 25 wherein the teeth in said series of external teeth and in said series of internal teeth are cammed on one side and have a precipitous edge on the other side.

28. The combination of claim 25 including embossments on said outer skirt surface, said indentation comprising an omission of said embossments in the region of said rupturable means.

29. The combination of claim 25 wherein said tab means does not protrude radially beyond the circumferential confines of said outer skirt surface.

30. The combination of claim 28 wherein said tab means does not protrude radially beyond the circumferential confines of said embossments.

31. The combination of claim 25 including indicia embossments on said top.

32. The combination of claim 25 wherein said closure is provided with a thinning of said inner skirt surface at the level of said series of interior teeth so that said closure substantially clears said series of exterior teeth until said series of exterior teeth engages said series of interior teeth.

33. A plastic closure cap for providing tamper evidence comprising a circular top and a cylindrical skirt depending therefrom, said cylindrical skirt having an outer skirt surface and an inner skirt surface, interior threads on said inner skirt surface for mating engagement with exterior threads on the neck of a container, a series of interior teeth in said inner skirt surface at a level below said interior threads for ratchetly interlocking engagement with a series of exterior teeth on the neck of said container below said exterior threads, rupturable means on said skirt on each side of said interior series of teeth, an indentation on said outer skirt surface above said rupturable means, tear tab means extending from said rupturable means and along said indention for tearing away a segment of said skirt containing said series of interior teeth at said rupturable means, said tearing away leaving a circumferential gap on said skirt, said gap providing visual evidence of tampering.

34. The closure cap of claim 33 wherein said closure cap is too rigid for squeezing to disengage said interlocking teeth.

35. The closure cap of claim 33 including embossments on said outer skirt surface, said indentation comprising an omission of said embossments in the region of said rupturable means.

36. The closure cap of claim 33 wherein said tab means does not protrude radially beyond the circumferential confines of said outer skirt surface.

37. The closure cap of claim 35 wherein said tab means does not protrude beyond the circumferential confines of said embossments.

38. The closure cap of claim 33 including indicia embossments on said top.

39. The closure cap of claim 33 including a bevel on said skirt surface at the intersection of said skirt and said top to facilitate grasping said tab for tearing.

40. The closure cap of claim 33 including providing a thinning on said inner skirt surface at the level of said series of interior teeth so that said closure cap substantially clears said series of exterior teeth until said series of exterior teeth engages said series of interior teeth.

* * * * *